US006439749B1

(12) United States Patent
Miller et al.

(10) Patent No.: US 6,439,749 B1
(45) Date of Patent: Aug. 27, 2002

(54) INTERNAL FIXTURE TRACKLIGHT SYSTEM

(76) Inventors: Jack V. Miller; Ruth E. Miller, both of 20961 Sussex Hwy. 13, Seaford, DE (US) 19973

( * ) Notice: Subject to any disclaimer, the term of this patent is extended or adjusted under 35 U.S.C. 154(b) by 0 days.

(21) Appl. No.: 09/917,515

(22) Filed: Jul. 30, 2001

(51) Int. Cl.[7] ..... F21S 8/06

(52) U.S. Cl. ..... 362/404; 362/239; 362/250; 362/427

(58) Field of Search ..... 362/404, 427, 362/287, 249, 250, 238, 239; 439/207, 115, 110

(56) References Cited

U.S. PATENT DOCUMENTS 3,718,816 A * 2/1973 Seelbach ..... 362/404
3,801,951 A * 4/1974 Kemmerer et al. ..... 362/404
4,493,519 A * 1/1985 Olsen
4,822,292 A * 4/1989 Thayer et al. ..... 439/207
5,259,774 A * 11/1993 Gabrius ..... 439/110
5,303,125 A * 4/1994 Miller ..... 362/141
5,325,272 A * 6/1994 Miller ..... 362/238
5,833,358 A * 11/1998 Patik ..... 362/391
6,170,967 B1 * 1/2001 Usher et al. ..... 362/394

* cited by examiner

*Primary Examiner*—Thomas M. Sember

(57) ABSTRACT

A tracklight system includes an elongated an elongated metallic track generally in the shape of a U, having a base and first and second parallel depending legs with proximal ends extending from the base of the U and having distal ends terminating in a common plane. An elongated insulator is attached to one of the depending legs and having longitudinal slots therein including electrical conductors. Track fixtures each include a fixture adapter attaching a luminaire to the track with an incandescent or gas-discharge luminaire disposed within the track U, substantially between the common plane of the legs and the base of the U. In a preferred embodiment the fixture adapter includes a swivel that permits the luminaire to pivot out of the track aim a light beam in azimuth and elevation.

7 Claims, 6 Drawing Sheets

INTERNAL FIXTURE TRACKLIGHT SYSTEM

BACKGROUND

1. Field of the Invention

This invention relates to the field of tracklights with positionable light fixtures electrically connected to pairs of track conductors in insulating grooves extending along depending sides of an elongated inverted U-shaped track. A track fixture is a light-producing luminaire with a fixture adapter mount and its electrical power connections. Power for the fixtures is provided from an electrical junction box main, connected to the track by an end-feed track-to-junction box connector. A number of depending track fixtures are positionable along the track and have luminaires that are mechanically and electrically connected to the track conductors with fixture mounting adapters. Line-voltage luminaires are connected to track conductors directly through a fixture adapter. Low-voltage luminaires are connected through a low-voltage power converter attached to a fixture adapter that is in turn mechanically and electrically connected to the track. Gas-discharge luminaires are connected through a ballast power converter attached to a fixture adapter that is mechanically and electrically connected to the track.

2. Description of the Invention

A popular tracklight system is shown in the applicant's U.S. Pat. No. 4,822,292 for a multiple-circuit track lighting system. Although it is unique in its multi-circuit selection simplicity, it is typical of prior-art tracklights in that it employs opposing electrical contacts on a fixture adapter that engages the track conductors in insulated slots on each depending leg of a U-shaped track.

A basic disadvantage of the above described and other prior-art tracklight systems is in the distance that the luminaire intrudes down into the room. This creates visual clutter of a number "tin cans" on the ceiling, gives the appearance of a low ceiling and often places hot luminaires within reach of occupants.

The above disadvantage was partially overcome by the applicant by using fiber optic luminaires inside a track according to U.S. Pat. No. 5,325,272, also based on the azimuth/elevation aiming fiber optic luminaires on U.S. Pat. No. 5,303,125. Although this has been successful for relatively low-level museum installations, the commercial lighting market needs the higher illumination levels than fiber optics can produce.

Another disadvantage of prior-art track systems is that the insulators and conductors occupy about 50% of the volume within the track leaving insufficient room to employ hidden luminaires.

OBJECTS OF THE PRESENT INVENTION

The principal objects of the present invention are to provide a tracklight system in which conventional-light-source luminaires may be hidden within the track, and do not extend downward into a room. This will reduce ceiling clutter, maintain the visual height of the ceiling and keepluminaires out of the reach of occupants. Another object of the invention is to provide a tracklight system in which luminaires hidden within the track have small aiming angles, but may be pulled down out of the track to be aimed in any direction.

BRIEF DESCRIPTION AND ADVANTAGES OF THE PRESENT INVENTION

The objects of the present invention are achieved by a tracklight system including an elongated an elongated metallic track generally in the shape of a U, having a base and first and second parallel depending legs extending from the base of the U and having distal ends terminating in a common plane. An elongated insulator is attached to one of the depending legs and having longitudinal slots therein including electrical conductors. Track fixtures each include a fixture adapter attaching a luminaire to the track with an incandescent or gas-discharge luminaire disposed within the track U, substantially between the common plane of the legs and the base of the U. In a preferred embodiment the fixture adapter includes a swivel that permits the luminaire to pivot out of the track and be aimed in azimuth and elevation.

REFERENCE NUMERALS IN DRAWINGS

| | |
|---|---|
| 1 prior-art track | 2 track extrusion |
| 3 insulator | 4 fixture adapter and connector |
| 5 connector | 6 prior-art line-voltage fixture |
| 7 prior-art fixture adapter | 8 prior-art line-voltage luminaire |
| 9 trunnion | 11 prior-art line-voltage track fixture |
| 12 fixture adapter and power converter | 13 prior-art low-voltage luminaire |
| 14 trunnion | 15 prior-art fluorescent track fixture |
| 16 fluorescent fixture adapter | 17 prior-art fluorescent fixture |
| 18 ballast power converter | 19 prior-art fiber optic track |
| 20 track extrusion | 21 fiber optic fixture adapter |
| 23 fiber optic luminaire | 22 fiber optic light guide |
| 24 X-Y axis aiming mirror | 25 fiber optic fixture |
| 26 line-voltage track system | 27 line voltage incand. fixture |
| 28 track extrusion | 29 base |
| 30 depending legs | 31 distal ends of depending legs |
| 32 line voltage incand. luminaire | 33 line voltage fixture adapter |
| 34 optical axis | 35 aiming mirror |
| 36 mirror mount | 37 power connector |
| 38 track insulator | 39 track conductors |
| 40 line-voltage lamp | 41 optical axis |
| 42 aiming mirror | 43 transverse axis |
| 44 pivot bracket | 45 luminaire housing |
| 46 heat shield | 47 low voltage track system |
| 48 low voltage fixture | 49 three-axis swivel |
| 50 low voltage fixture adapter | 51 pivot bracket |
| 52 low-voltage luminaire | 53 reflector |
| 54 azimuth bracket | 55 low-voltage power converter |
| 56 low-voltage flex cable | 57 elevation bracket |
| 58 low-voltage lamp | 59 luminaire housing |
| 60 fluorescent track system | 61 fluorescent track fixture |
| 62 fluorescent luminaire | 63 fluorescent fixture adapter |
| 64 ballast power converter | 65 lamp |
| 67 linear fresnel lens | 69 reflector |

DETAILED DESCRIPTION OF THE DRAWINGS

Figures 1, 2, 3, 4, 5:
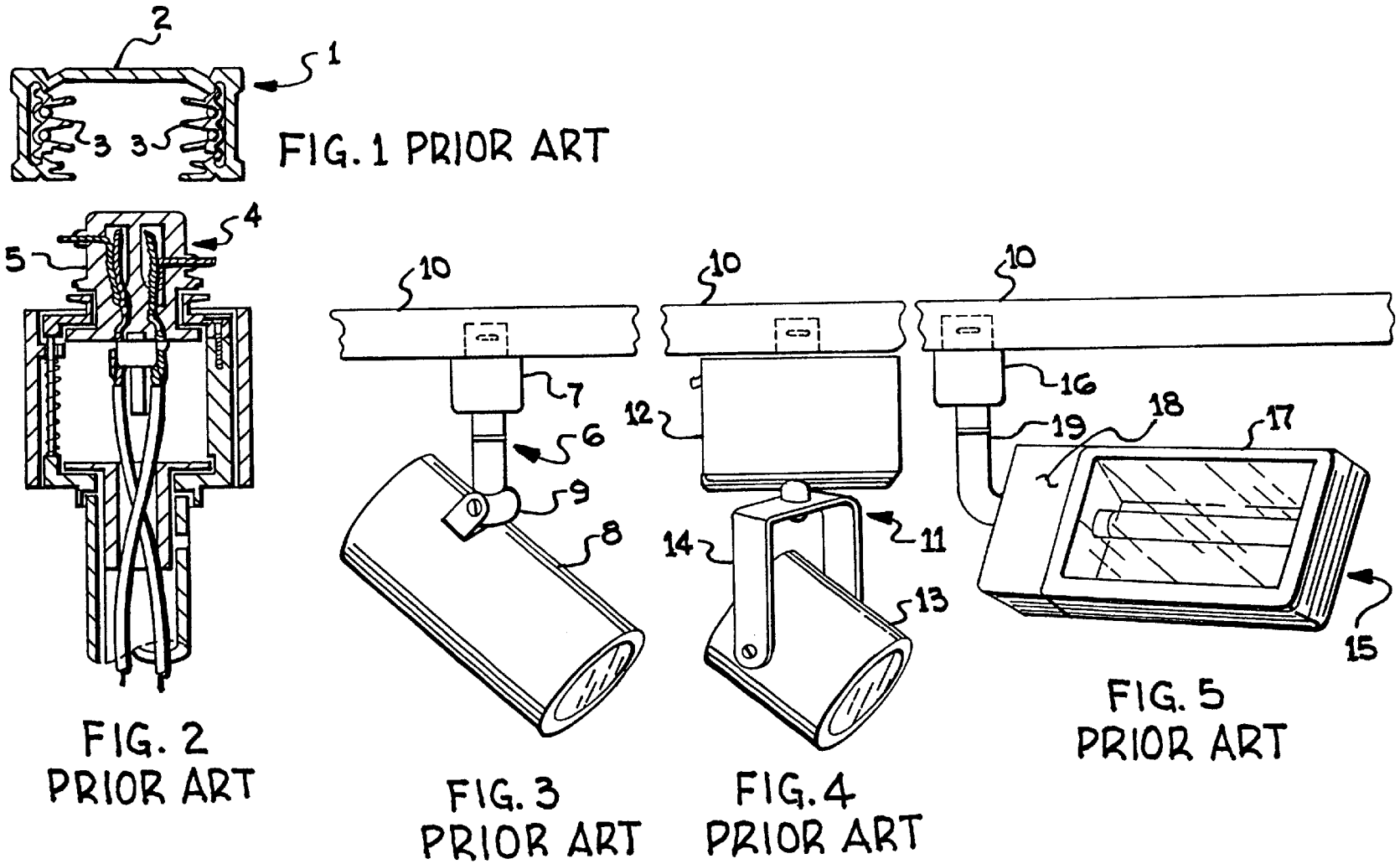
FIG. 1 PRIOR ART
FIG. 2 PRIOR ART
FIG. 3 PRIOR ART
FIG. 4 PRIOR ART
FIG. 5 PRIOR ART
FIG. 1 is a transverse cross-sectional view of a prior-art two-circuit track according to the applicant's U.S. Pat. No. 4,822,292.
FIG. 2 is a transverse cross-sectional view of a prior-art fixture adapter and luminaire-to-track connector engageable into the track of FIG. 1.
FIG. 3 is a side elevation view of a typical prior-art track system showing a line-voltage luminaire attached through a fixture adapter to a track.
FIG. 4 is a side elevation view of a typical prior-art track system showing a low-voltage luminaire attached through a low-voltage power converter and a fixture adapter to a track.
FIG. 5 is a side elevation view of a prior-art track system showing a fluorescent luminaire including a ballast power converter, attached through a fixture adapter to a track.

In FIG. 1 a transverse cross-sectional view of a prior-art track 1 according to the applicant's U.S. Pat. No. 4,822,292 is shown having an elongated. Generally "C" shaped metal track extrusion 2 enclosing a pair of conductor-carrying insulators 3, occupying approximately half the space within track extrusion 2.

In FIG. 2 a fixture mounting adapter 4 of the applicant's U.S. Pat. No. 4,822,292 is configured to be inserted into track 2 and twisted to engage and connect a fixture to the track. When installed, connector 5 of adapter 4 occupies the space within the track 1 above a fixture.

In FIG. 3 a prior-art line-voltage track fixture 6 is shown using a fixture adapter 7 and a line-voltage luminaire 8 supported on a trunnion 9 and depending down into a room from a track 10.

In FIG. 4 a prior-art low-voltage track fixture 11 is shown using a low-voltage power converter and fixture adapter 12 connected to a track 10 and a low-voltage luminaire 13 supported on a trunnion 14 and depending down into a room.

In FIG. 5 a prior-art fluorescent track fixture 15 is shown having a fluorescent luminaire 17 depending into a room and including a ballast power converter 18 connected to track 10 by fixture adapter 16 and trunnion 19.

Figure 6:
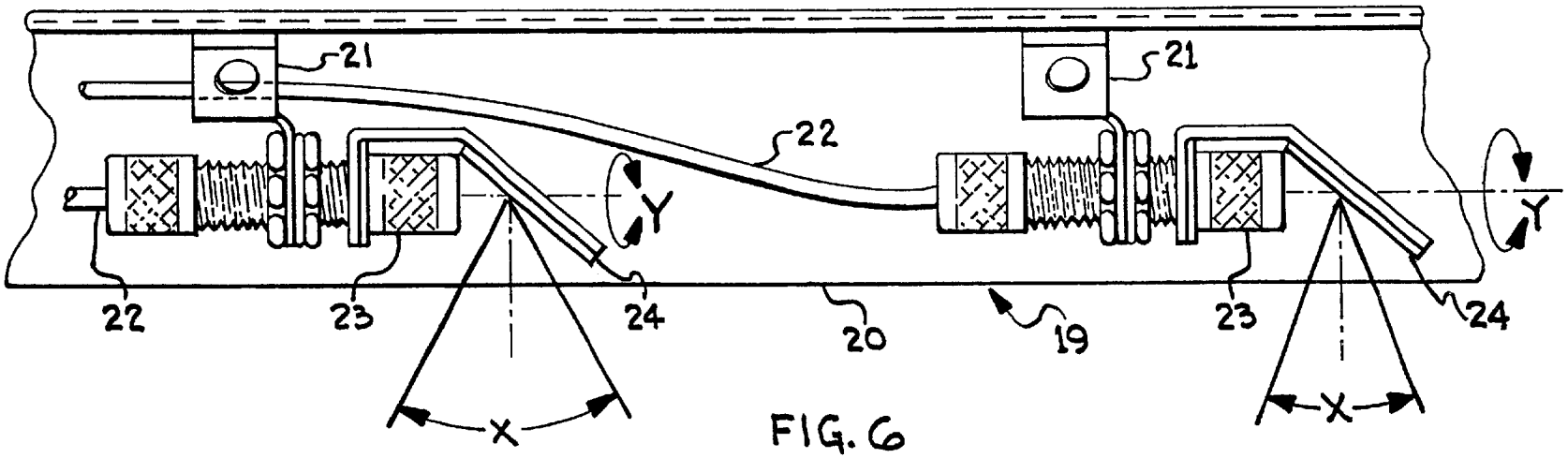
FIG. 6 PRIOR ART
FIG. 6 is a side elevation cross-sectional view of a prior-art track using fiber optic luminaires.
Figure 7:
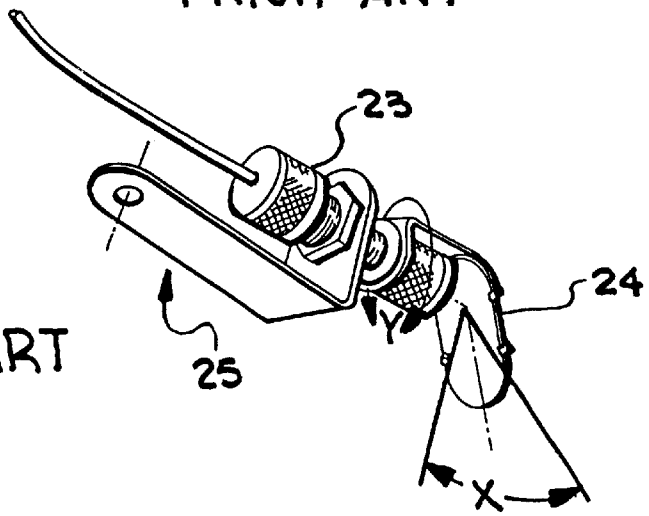
FIG. 7 PRIOR ART
FIG. 7 is a perspective view of an aimable prior-art fiber optic luminaire.

FIGS. 6 and 7, respectively, show a side elevation cross-sectional view of a prior-art track according to the applicant's U.S. Pat. No. 5,325,272, and azimuth/elevation aiming fiber optic luminaires 26 from the applicant's U.S. Pat. No. 5,303,125 20 as shown in FIG. 7. In FIG. 6 fixture adapters 21 support fiber optic luminaires 23 at selected locations along the track extrusion. Light enters the luminaires through fiber optic light guides 22 and movable mirrors 24 aim the light beams through included angles X and Y.

Figure 8:
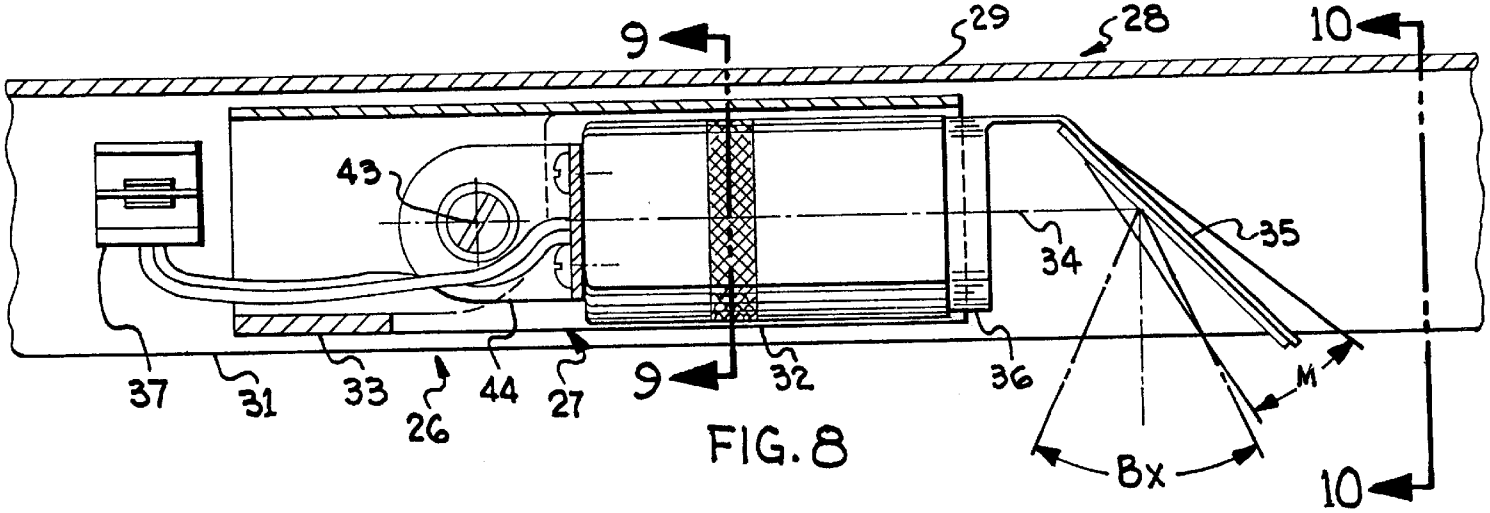
FIG. 8 is a side elevation cross-sectional view of a first preferred embodiment of a track according to the present invention including an incandescent-lamp track fixture disposed within the track.
Figure 10:
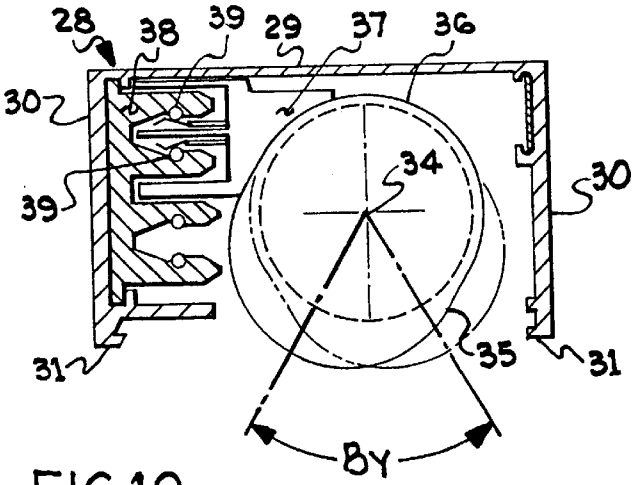
FIG. 10 is a transverse cross-sectional view of a track according to the present invention, taken along section line 10—10 of FIG. 8.

In FIG. 8 a side elevation cross-sectional view of a first preferred embodiment of a track system 26 is shown according to the present invention and having a line-voltage incandescent fixture 27 within a metallic track extrusion 28 comprising a base 29 and depending legs 30, terminating at their distal ends 31 in a common plane. Fixture 27 includes an incandescent luminaire 32 and a luminaire-supporting fixture adapter 33, both disposed within track extrusion 28 and held in a retracted position therein by pivot bracket 44. Incandescent luminaire 32 is connected to line-voltage track power through a connector 37, which engages track conductors 39 in insulator 38 as shown in FIG. 10. Luminaire 32 emits light on an optical axis 34, and the light is aimed by reflection off mirror 35 which is movable through mirror angle M, providing beam angle Bx. Mirror mount 36 may be rotated about optical axis 34 to aim a beam though angle BY as seen in FIG. 10.

Figure 9:
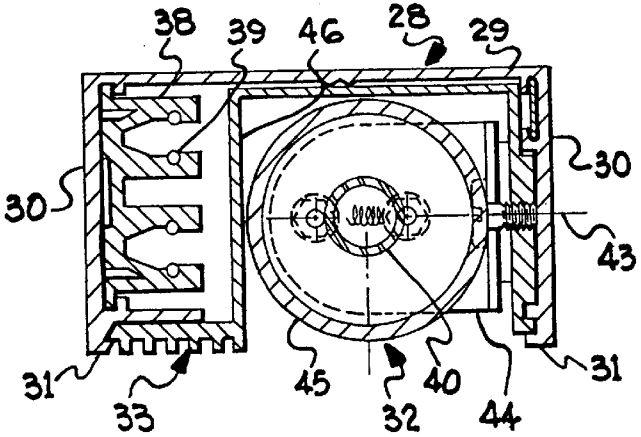
FIG. 9 is a transverse cross-sectional view of a track of FIG. 8, taken along section line 9—9.

In FIG. 9 luminaire 32 is shown having a line-voltage incandescent lamp 40, within a housing 45. Fixture adapter 33 is supported in track extrusion 28 and includes a heat shield 46 to protect insulator 38 from lamp heat.

FIG. 10 shows power connector 37 plugged into track conductors 39 in insulator 38. Aiming mirror 35 is shown rotated through angle BY about the optical axis 34.

Figures 11, 12:
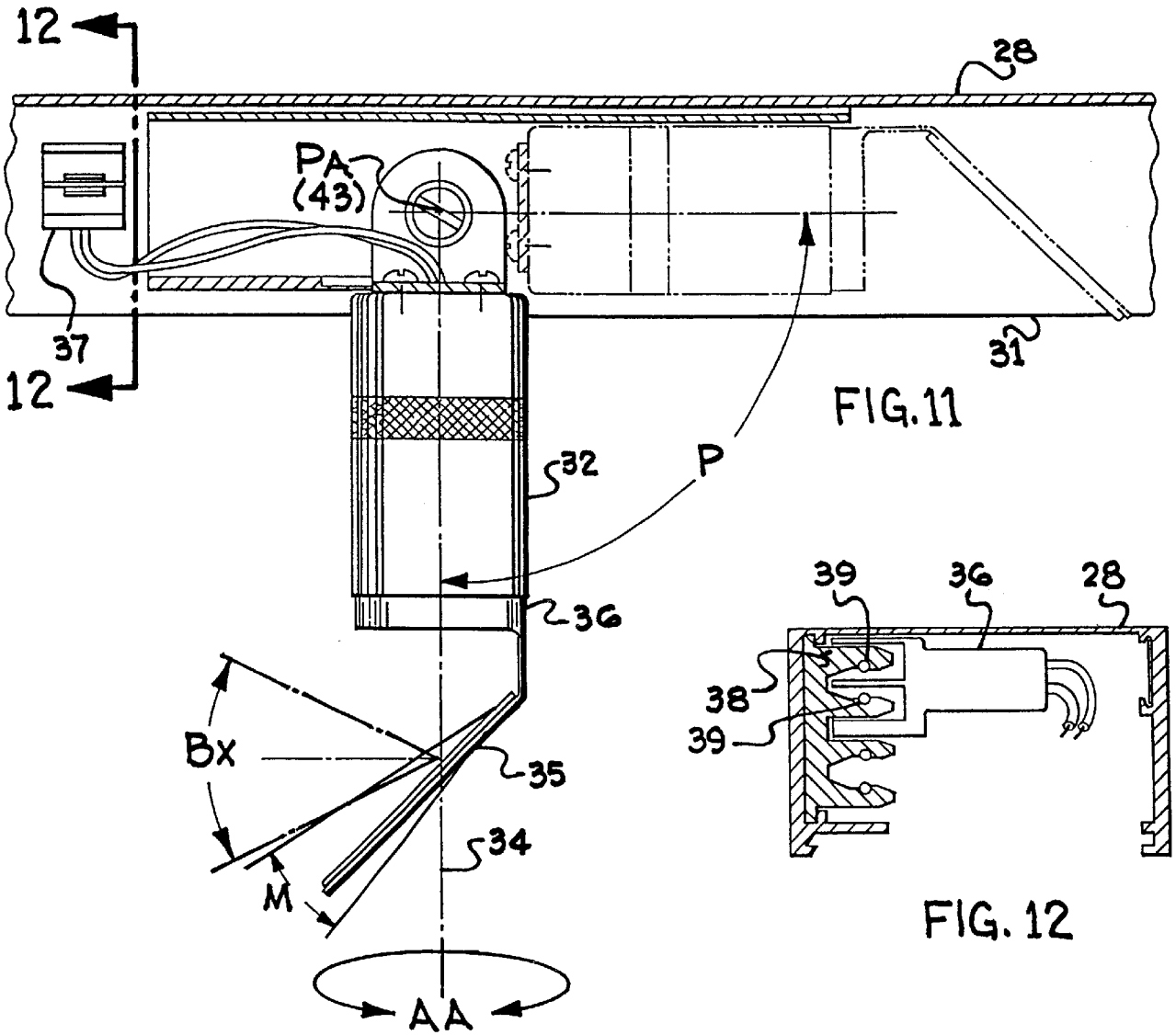
FIG. 11 is a side elevation cross-sectional view of the first preferred embodiment of FIG. 8, showing an incandescent lamp fixture pivoted out of the track to the nadir axis.
FIG. 12 is a transverse cross-sectional view of a track according to the present invention, taken along section 12—12 and showing a connection from a luminaire to the track conductors.

In FIG. 11 luminaire 32 is shown rotated through pivot angle P about pivot axis $P_A$ (43) to depend from track 28. As is FIGS. 8 and 10, mirror 35 may be moved through angle M to aim the light beam through elevation angle Bx, and mirror mount 36 can rotated about optical axis 34 to rotate the beam about the Azimuth Axis $A_A$.

FIG. 12 is a transverse cross section taken along section 12—12 of FIG. 11, showing a connection from a luminaire to the track conductors 39 in extrusion 28.

Figure 13:
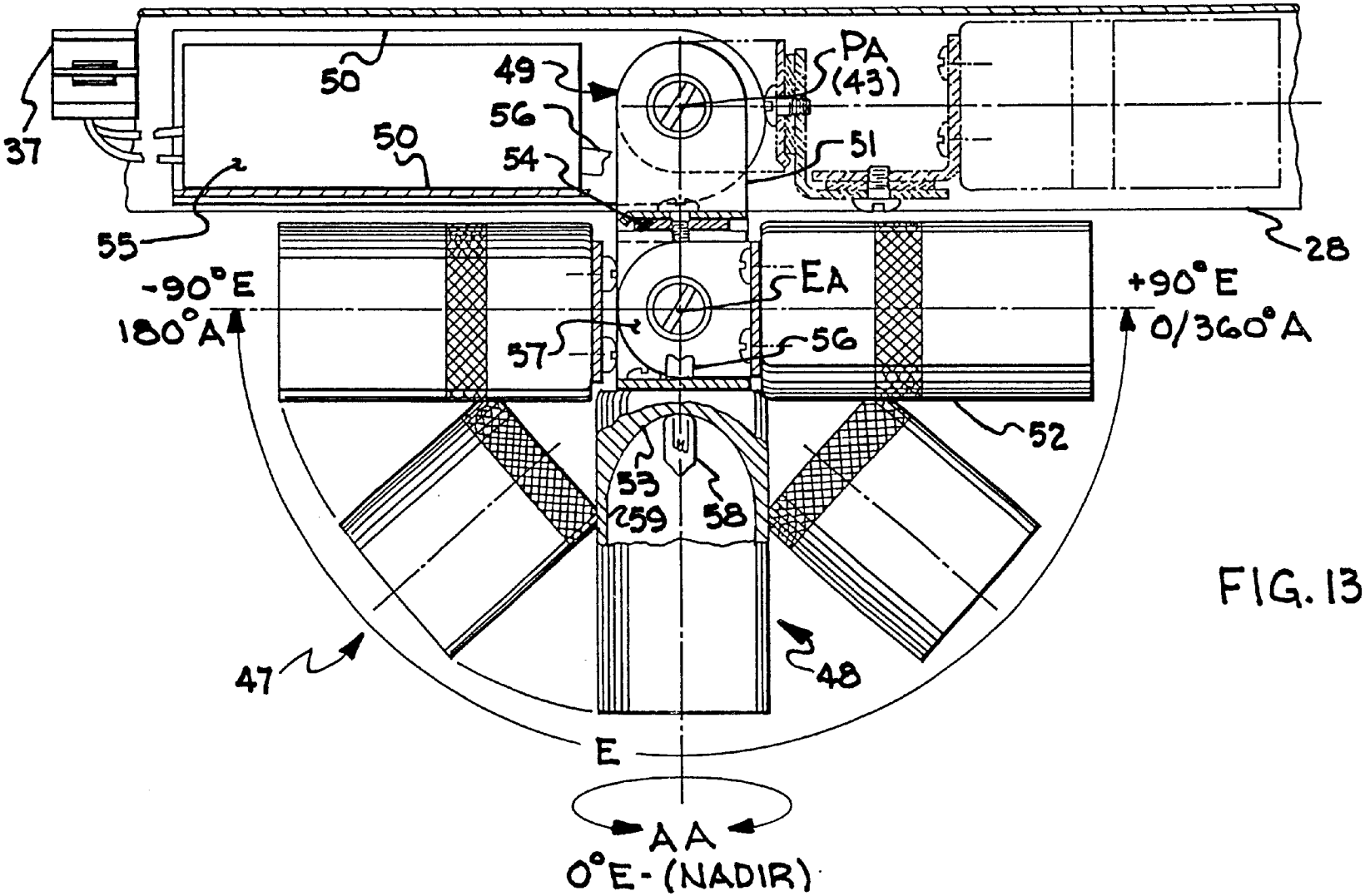
FIG. 13 is a side elevation cross-sectional view of a second preferred embodiment of a track according to the present invention including an incandescent lamp track fixture pivoted out of the track to the nadir axis.

In FIG. 13 a low-voltage track system 47 according to a preferred embodiment of the invention is shown having a low-voltage fixture 48 pivoted downwards from a track 28, which is identical to the tracks 28 of FIGS. 8, 9, 10, 11 and 12. Low-voltage fixture 48 is comprised of low-voltage luminaire 52, three-axis swivel 49, a fixture adapter 50, low-voltage power converter 55, low-voltage flex cable 56 and line-voltage track connector 37. Luminaire 52 is rotated downwards on pivot bracket 51 about pivot axis $P_A$ (43) as seen in FIGS. 8 and 12. An azimuth bracket 54 is rotatable on pivot bracket 51 about azimuth axis $A_A$. Luminaire 52 can be then rotated on elevation bracket 57 about elevation axis $E_A$, through angles E from 0°/360° to 180° in elevation, and can be rotated 360° about azimuth axis $A_A$, whereby the luminaire has unrestricted aiming from beneath the track. On occasions when the luminaire is not in use, power connector 37 may be disconnected from the track conductors 39 as shown in FIG. 12 and the luminaire put into the retracted position, shown in phantom in FIG. 13, where it is out of sight. Low-voltage luminaire 52 is shown having a low-voltage lamp 58, within a reflector 53 in luminaire housing 59 and energized by low-voltage power converter 55, which is plugged into line voltage conductors 39 by plug 37 as shown in FIG. 12.

Figure 14:
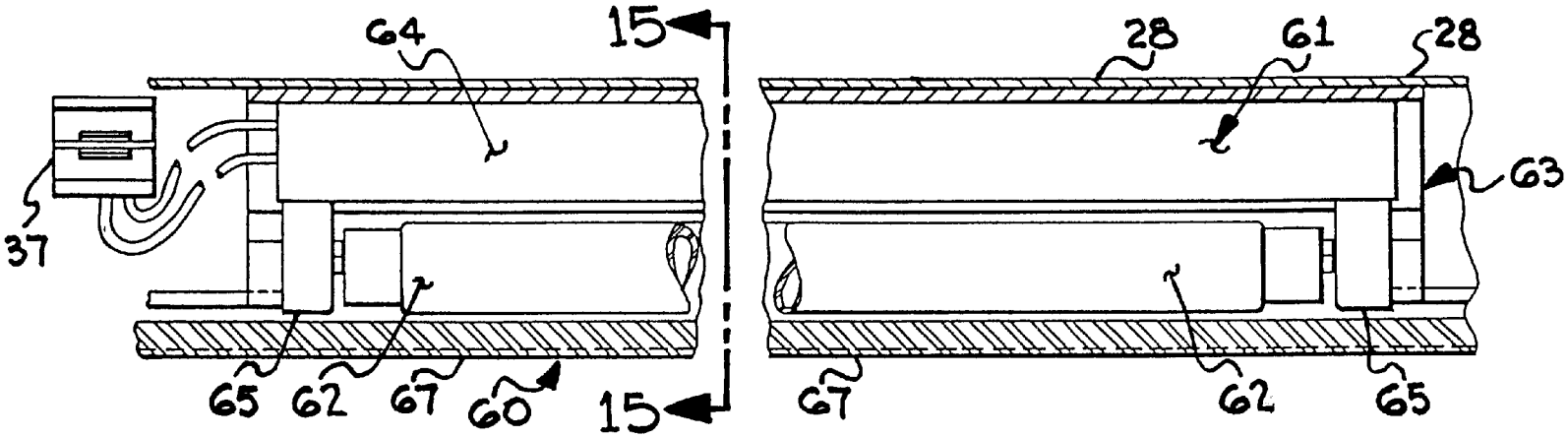
FIG. 14 is a side elevation cross-sectional view of a third preferred embodiment of a track according to the present invention including a fluorescent lamp track fixture disposed within the track.
Figure 15:
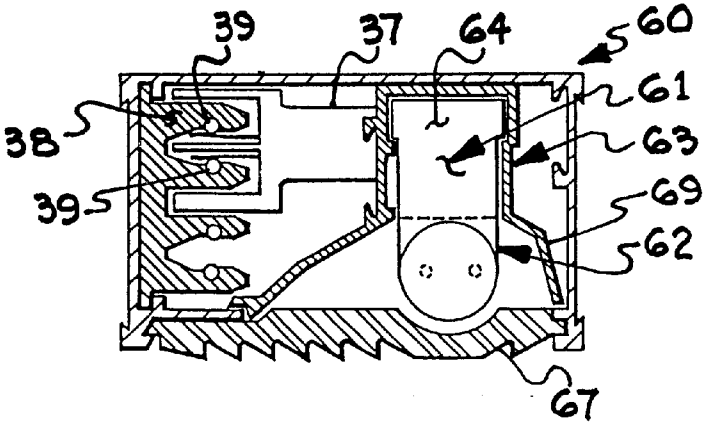
FIG. 15 is a transverse cross-sectional view of a track according to the present invention of FIG. 14, taken along section line 15—15 of FIG. 14.

FIGS. 14 and 15 show a fluorescent embodiment of a track system 60 of the present invention in which a fluorescent lighting fixture 61 is retained within track 28, which is identical to the track 28 of FIGS. 8 through 13, by fixture adapter 63. Fluorescent lamp 62 is connected to a ballast power converter 64 through a pair of lampholders 65. Ballast power converter 64 is, in turn, is connected by connector 37 to track conductors 39 in insulator 38, which is also identical to those of FIGS. 8 through 13. A lens 67 is provided for optical control and ultraviolet absorption. Lens 57 is shown as a linear fresnel lens, but the optical configuration may be of any conventional design, such as a translucent opal diffuser, pyramidal prism or linear prism lens.

OPERATION, RAMIFICATIONS AND SCOPE

In operation the present invention provides great versatility in luminaire selection in which a single track configuration can accommodate line-voltage luminaires, low-voltage luminaires and/or gas-discharge-lamp luminaires, all hidden within the track profile. This provides a tracklight system in which luminaires do not extend downward into a room, reducing ceiling clutter, maintaining the visual height of the ceiling and keeping luminaires out of the reach of occupants. However, in a preferred embodiment a luminaire may be pivoted down out of the track to be aimed in azimuth and elevation. It will be obvious to anyone skilled in the art that a great variety of lamps, lumimaires and power converters may be used in track fixtures within the track, and that many reflectors, lenses and other optical systems may be used to control, diffuse, aim and even color the emitted light, all of within the scope of this disclosure.

What is claimed is:

1. A tracklight system (26, 47, 60) comprising:

an elongated metallic track extrusion (28) generally in the shape of a U, having a base (29) and first and second parallel depending legs (30) extending from the base of the U and having distal ends (31) in a common plane;

an elongated insulator (38) attached to at least one of the depending legs has one or more pairs of partially-embedded conductors (39) in longitudinal slots, said conductors (39) connected to an external source of mains power;

at least one light fixture (27, 48, 61) disposed within the track U, substantially between the common plane of the legs and the base 29 of the U, said fixture comprising a luminaire (32, 52, 62) and a fixture adapter (33, 50, 63) attaching the luminaire to the track; and an electrical connector (37) supplying electrical power to the light fixture from the track conductors (39).

2. A tracklight system according to claim 1 in which the luminaire emits a light beam on an optical axis (34), and said luminaire includes a movable mirror (35) reflecting light generally transverse to the optical axis (34).

3. A tracklight system (27) according to claim 1 in which the fixture adapter includes a pivot bracket (44) permitting the luminaire (32) to pivot down out of the track, and in which the luminaire (32) emits a light beam on a nadir axis, said luminaire including a movable mirror (35) reflecting light generally transverse to the optical axis and aimable in azimuth and elevation.

4. A tracklight system (47) according to claim 1 in which the fixture adapter (50) includes a three-axis swivel (49) permitting the luminaire (52) to pivot down out of the track (28), and in which the luminaire (52) emits a light beam on an optical axis which is aimable in azimuth and elevation.

5. A tracklight system (47) according to claim 1 in which the lighting fixture (48) includes a power converter (55) and a low-voltage-lamp luminaire (52).

6. A tracklight system (60) according to claim 1 in which the lighting fixture (61) includes a ballast power converter (64) and a gas-discharge-lamp luminaire (62).

7. A tracklight system (60) according to claim 1 in which the lighting fixture (61) includes a ballast power converter (64) and a gas-discharge-lamp luminaire (62) having a lens (67) elected from the group including pyramidal prismatic, longitudinal linear-prism, longitudinal linear lenticular lenses and various diffusers.

* * * * *